US008261589B2

(12) United States Patent
Bäumer et al.

(10) Patent No.: US 8,261,589 B2
(45) Date of Patent: Sep. 11, 2012

(54) METHOD AND DEVICE FOR COILING THIN METAL STRIP, ESPECIALLY HOT ROLLED OR COLD-ROLLED THIN STEEL STRIP

(75) Inventors: Klaus Bäumer, Kreuztal (DE); Klaus Ginsberg, Siegen (DE); Matthias Tuschhoff, Siegen (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 168 days.

(21) Appl. No.: 12/799,065

(22) Filed: Apr. 17, 2010

(65) Prior Publication Data

US 2010/0263423 A1 Oct. 21, 2010

Related U.S. Application Data

(62) Division of application No. 11/703,435, filed on Feb. 7, 2007, which is a division of application No. 10/488,039, filed as application No. PCT/EP02/09285 on Aug. 20, 2002, now Pat. No. 7,191,627.

(30) Foreign Application Priority Data

Aug. 29, 2001 (DE) ..... 101 42 179

(51) Int. Cl.
*B21C 47/24* (2006.01)

(52) U.S. Cl. ..... 72/148; 242/571

(58) Field of Classification Search ..... 72/146, 72/148, 393; 242/571, 571.1, 571.2, 577–577.3
See application file for complete search history.

(56) References Cited

U.S. PATENT DOCUMENTS

| | | | | |
|---|---|---|---|---|
| 3,881,666 | A * | 5/1975 | Greenhalgh | 242/571.3 |
| 4,155,242 | A * | 5/1979 | Peterson | 72/392 |
| 2001/0020379 | A1 * | 9/2001 | Ginzburg et al. | 72/229 |

* cited by examiner

*Primary Examiner* — Debra Sullivan
(74) *Attorney, Agent, or Firm* — Lucas & Mercanti, LLP; Klaus P. Stoffel

(57) ABSTRACT

A method for coiling thin metal strip, especially hot-rolled or cold-rolled thin steel strip, on a coiler mandrel, which is adjusted in diameter, in which, at the beginning, the inner windings of the coil are coiled on the adjusted coiler mandrel diameter, and, after the final winding of the coil, the coiler mandrel is pulled out, or the coil is taken off, wherein one or more profile grooves are pressed into one inner winding or into several adjacent inner windings on the circumference during rotation of the coil.

3 Claims, 6 Drawing Sheets

FIG. 1
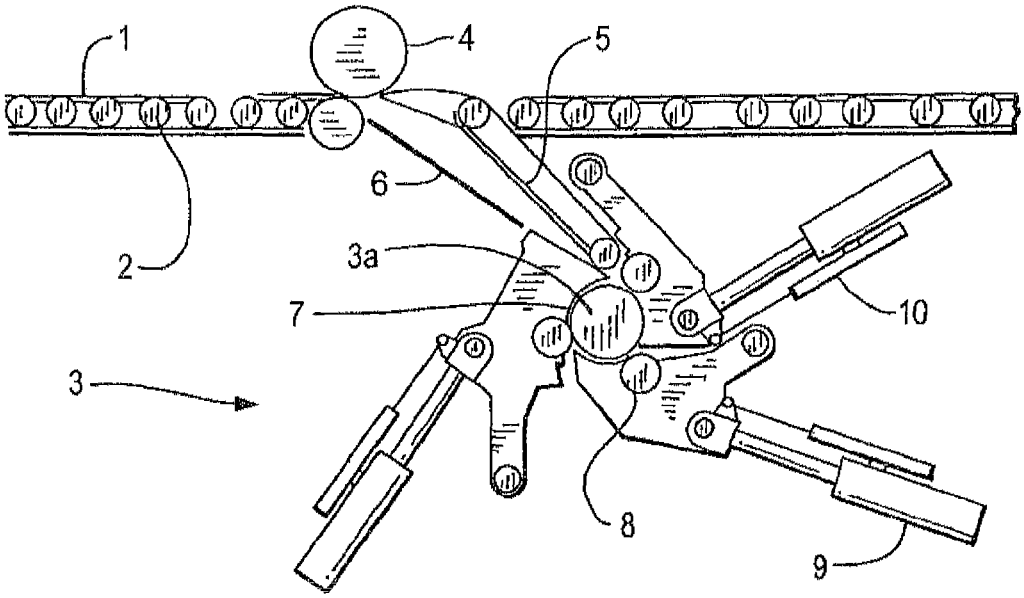
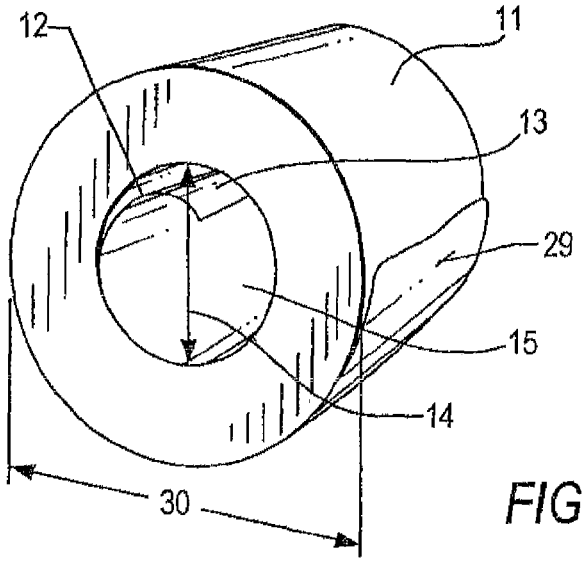
FIG. 2

METHOD AND DEVICE FOR COILING THIN METAL STRIP, ESPECIALLY HOT ROLLED OR COLD-ROLLED THIN STEEL STRIP

CROSS-REFERENCE TO RELATED APPLICATIONS

This application is a Divisional Application of U.S. patent application Ser. No. 11/703,435, filed Feb. 7, 2007, which is a Divisional Application of U.S. patent application Ser. No. 10/488,039, filed Jul. 19, 2004 now U.S. Pat. No. 7,191,627, which is the National Phase Application of PCT/EP02/09285, filed Aug. 20, 2002.

BACKGROUND OF THE INVENTION

The invention concerns several methods and several devices for coiling thin metal strip, especially hot-rolled or cold-rolled thin steel strip, on a coiler mandrel, which is adjusted in diameter, in which, at the beginning, the inner windings of the coil are coiled on the adjusted coiler mandrel diameter, and, after the final winding of the coil, the coiler mandrel is pulled out, or the coil is taken off.

Hot-rolled, high-grade thin steel strip is being produced in greater and greater amounts and is now approaching cold-rolled steel strip in both quantity and thickness. This is the result of great advances in the rolling technology of hot-rolled flat strip. It has become economical to produce very thin hot-rolled flat products (ultrathin gages) of less than 2 mm in greater and greater amounts.

Now that the rolling installations are capable of producing such thin hot-rolled flat products, the machines that follow the rolling installations, e.g., the roller table, strip cooling devices, coiler, coil conveyance equipment, and the like, must also be able to meet the new requirements.

A problem that arises during and after the coiling of thin steel strip is that the inner windings of the coil become detached and collapse on themselves. Subsequent winding of the coil onto a coiler mandrel of the uncoiling machine or of another machine for further processing is not possible or is possible only with additional labor and expense. The inner windings of the coil must be cut from the eye of the coil by hand. This manual work reduces the productivity of the plant.

U.S. Pat. No. 5,705,782 describes a spot welding device, which is arranged on a guided support assembly and can be inserted into the eye of the coil to place the weld spots on the inner winding of the coil by electrodes.

In Patent Abstracts of Japan, Vol. 014, No. 478 (M-1036) of Oct. 8, 1990, a method is described in which the steel strip is bonded with a double-sided adhesive tape with the continuous use of a tape-like process material and a special coiling device with a pressing roll to coil the steel strip together with the adhesive tape on a reel. Moreover, no expandable coiler mandrel is provided. Although this makes it possible to prevent the collapse of the inner windings at the beginning of the coiling process, the method is uneconomical in light of the double-sided adhesive tape that is continuously required. In addition, a considerably greater length of steel strip must later be regarded as scrap.

JP 50[1975]-113 456 A, published on Sep. 5, 1975, describes another well-known method. There is no provision for a coiler mandrel with an adjustable diameter. The method involves the use of a punching machine for punching holes by making free punches of flap pieces, such that in each case in a row an upper flap of an outer winding is to be pressed against the next more inner flap of the innermost winding of the eye of the coil. An expandable coiler mandrel could be damaged by the projections that are formed. Here again, collapse of the inner windings of a coil is prevented, but it would be necessary to avoid damage to an expandable coiler mandrel that might be inserted.

The problem of the collapse of the inner winding arises with decreasing strip thickness. Other parameters that have an effect are, for example, material properties, coiler temperature, and strip width. The metal strip no longer has sufficient inherent rigidity and falls into the inside opening of the coil (coil eye) under its own weight and thus reduces the inside diameter of the coil. The problem develops immediately after the coiling of the coil and its removal from the coiler mandrel and intensifies as the coil is further conveyed, until several inner windings have become separated. The aforementioned spot welding method or fastening by welding or by winding on a sleeve is used in the cold rolling and coiling of thin steel strip.

SUMMARY OF THE INVENTION

The objective of the invention is to prevent the separation of individual windings in the eye of the coil by stiffening the windings.

The stated objective is achieved by a first method in accordance with the invention, in which one or more profile ridges or profile grooves are pressed into one inner winding or into several adjacent inner windings on the circumference during rotation of the coil.

This measure results in stiffening of the first two windings in such a way that the end of the strip is able to support itself again, and individual windings cannot become separated. In this regard, it is sufficient to profile only slightly more than one inner winding. In no case is it necessary to profile more than 2-3 windings.

It is advantageous to press the profile ridges or profile grooves by means of the profiled, rotationally driven coiler mandrel.

In addition, the profiles can be pressed during the coiling of the metal strip.

Another embodiment is characterized by the fact that, after the coiling of the first winding on the coiler mandrel, a re-expansion is carried out, and the profiles are pressed into the inner windings with a force that depends on the strip and the material. In this way, neither the preceding operational sequence nor the design of the coiler mandrel are appreciably altered.

The method can be advantageously applied to strip gages on the order of 0.4 to 1.8 mm.

The associated device for coiling thin metal strip, especially hot-rolled or cold-rolled thin steel strip, with a drivable coiler mandrel, which can be adjusted in diameter by means of expandable segments and can be adjusted to a coil inside diameter and to a diameter for detaching the finished coil, achieves the stated objective of the invention by virtue of the fact that the segments are provided with segmental profile ridges. These profile ridges are pressed into the metal strip by the coiler mandrel forward slip or a re-expansion operation and form grooves in it, which leads similarly to a stiffening of the grooved inner windings. The profile ridges are designed according to the required plastic deformation of the metal strip and must not hinder the removal of the coil from the coiler mandrel. In this way, no additional machine is needed, but rather merely one more function is transferred to the coiler mandrel. The pressing of grooves causes no damage to the strip edges, as occurs by welding or binding. Existing plants can be easily retrofitted. Downstream installations require no modifications.

In a modification of this device, it is provided that the segmental profile ridges are interchangeable and can be adapted in height and width to the metal strip.

The width and height of the profile ridges can also be advantageously established as a function of the strip gage and the material properties.

In accordance with the invention, a second method for achieving the objective of the invention is characterized by the fact that the inner windings of the coil are mechanically supported along the circumference during or immediately after the removal of the coil from the coiler mandrel in the eye of the coil. This also prevents the inner windings from collapsing.

The inner windings are held against the adjacent middle windings by the inner windings being supported by radial expansion of support elements away from the central axis.

In accordance with a modification, it is provided that the supporting of the inner windings overlaps the removal of the coil from the coiler mandrel.

Further advantages are derived from the fact that the support elements are kept in their supporting position during the coil conveyance and the cooling phase and up to the uncoiling of the coil.

The associated device for coiling thin metal strip, especially hot-rolled or cold-rolled thin steel strip, with a drivable coiler mandrel, which can be adjusted in diameter by means of expandable segments and can be adjusted to a coil inside diameter and to a diameter for detaching the finished coil, achieves the stated objective of the invention by virtue of the fact that an expansion adapter is provided, which can be inserted into the open eye of the coil and is mounted on a holder with a guide. After the coiling of the coil, the mandrel step bearing opens, and the coil sled conveys the coil out of the coiler and pushes it by the device with the expansion adapter into a standby position. The device with the expansion adapter then turns the loose windings back in the opposite coiling direction until the windings rest against each other again. To this end, the expansion adapter expands during the turning operation. The expansion adapter then presses against the inner windings without damaging them, and a disconnection from the holder and the expansion adapter is carried out. The expansion adapter remains in the coil and is removed only later at a downstream station. Collapsing of the inner windings is thus prevented. The turning back and fixation can also occur during the conveyance of the coil away from the coiler mandrel, which saves time.

In accordance with a modification, it is advantageous with respect to the necessary movements to provide the expansion adapter with connections for media, power, and control mechanisms.

In accordance with a refinement, the expansion adapter is rotatably supported in the holder. In accordance with the above description, the expansion adapter can be fixed in place in the eye of the coil without triggering the turning back of the loose windings. The device with the expansion adapter can thus be realized optionally with or without a turning mechanism.

In accordance with another handling method, the expansion adapter can be removed at a downstream station for treatment of the coil.

Additional features of the expansion device derive from the fact that the expansion adapter has several support elements distributed along the circumference. It is also possible to provide a simple mechanism for disconnecting the expansion adapter from the holder or locking it.

Another feature of the expansion adapter is that it can be mechanically locked in the operating position in the eye of the coil.

Another advantage is that the expansion adapter can be mass-produced and can be assigned to each coil. The expansion adapter can be removed from the coil at the following station. It can be removed manually or by machine and then returned for reuse. The expansion adapter is constructed in a simple, light, and easily handled design, so that mass production is economical for equipping a large number of coils. The system with expansion adapters likewise avoids damage to the edges of the strip by welding. Retrofitting in existing plants is possible.

In a variant of this method, the rotationally driven coiler mandrel serves as the holder for the expansion adapter.

In accordance with the invention, a third method for achieving the objective of the invention is characterized by the fact that at least the first inner winding is joined over a large area with the second inner winding by introducing adhesives, fillers, pieces of metal, bonding agents, or the like into an angular space between the inner windings. This holds the first and second inner windings together, which also produces stiffening of the inner windings.

In a modification of this type of joining or joint system, it is provided that the adhesive is sprayed into the angular space between the first and second inner windings.

In another variant, a wire-like body is played into the angular space between the first and second inner windings as a filler to produce positive interlocking.

In a third variant, individual metal bodies are introduced into the angular space between the first and second inner windings to produce positive interlocking.

Finally, in a fourth variant, a bonding agent is applied in the angular space between the first and second inner windings.

The associated device for coiling thin metal strip, especially hot-rolled or cold-rolled thin steel strip, with a drivable coiler mandrel, which can be adjusted in diameter by means of expandable segments and can be adjusted to a coil inside diameter and to a diameter for detaching the finished coil, achieves the stated objective of the invention by virtue of the fact that a spreading, spraying, or injecting device is provided, which is connected to a reservoir for adhesives, fillers, metal bodies, bonding agents, or the like. Accordingly, no complicated machines are necessary to achieve the desired effect, but rather only a simple device for supplying materials or bodies is needed. When adhesives or bonding agents are introduced, only a short amount of time is required to join the two inner windings. In addition, damage to the strip edges by welding is again eliminated. Existing plants can be easily retrofitted with the device. No alterations are required at subsequent treatment stations. The joint that has been created pulls apart by itself at subsequent processing stations.

Additional advantages derive from the fact that the spreading, spraying, or injecting device can be precisely actuated with respect to time by a computer-controlled control system.

The device can be refined by providing the spraying or injecting device with a nozzle for the systematic introduction of adhesive or bonding agent.

In accordance with the invention, a fourth method for achieving the objective of the invention is characterized by the fact that, if the coil is being wound in the clockwise direction, the leading end of the strip is positioned in the eye of the coil in an angular sector within the 7-10 o'clock range, and if the coil is being wound in the counterclockwise direction, the leading end of the strip is positioned in the eye of the coil in an angular sector within the 2-5 o'clock range, and then the coil is taken off the coiler mandrel. The weight $F_G$ of the end of the strip forces (normal force $F_N$) the end of the strip to be pressed against the next inner winding, thereby preventing collapse of the winding, and, in addition, produces the frictional force $F_R$, which prevents the inner winding from separating from the second inner winding or sliding on the second inner winding.

In this regard, it is also advantageous for the trailing end of the strip to be positioned in an angular region below 270°.

In a modifying step, the position of the given leading end of the strip is determined by integrating the peripheral speed of one of two drive rolls of the coiler or the mean value of the drive roll peripheral speeds. In this way, only control-engineering measures within the drive control system and its programs are necessary, so that the expense is further reduced.

Another refinement provides that the position of the leading end of the strip is determined by integrating a speed signal from a speed-measuring device between a piece of rolling equipment and the coiler.

Another measure for determining the position of the trailing end of the strip and/or the leading end of the strip consists in comparing the surface speeds of the coiler mandrel and the inner surface of the coil. When there is agreement within a preset range of error, the position of the leading end of the strip on the coiler mandrel is stored, and then the position of the mandrel is monitored in the further course of coiling.

The designated surface speed can be determined, for example, in such a way that the surface speed of the inner surface of the coil is determined from the speed signal used for the integration and from an instantaneous outer diameter and instantaneous inner diameter of the coil being formed.

Other aids involve determining a position of the coiler mandrel by evaluating a fixed pulse from a speed sensor located on the coiler mandrel or mandrel drive and integrating the speed of the coiler mandrel drive between two pulses.

In another measurement step for determining the trailing end and leading end of the strip, after the position of the leading end of the strip has been stored, the peripheral speeds of the coiler mandrel and the inner surface of the coil are repeatedly compared, and, when deviations are detected, the actual effective diameter of the drive rolls of the coiler is corrected.

Embodiments of the invention are illustrated in the drawings and explained in greater detail below.

BRIEF DESCRIPTION OF THE DRAWING

FIG. 1 shows a side view of a complete coiler with a conveyance roller table.

FIG. 2 shows a perspective view of a finished coil.

DETAILED DESCRIPTION OF THE INVENTION

Figure 3:
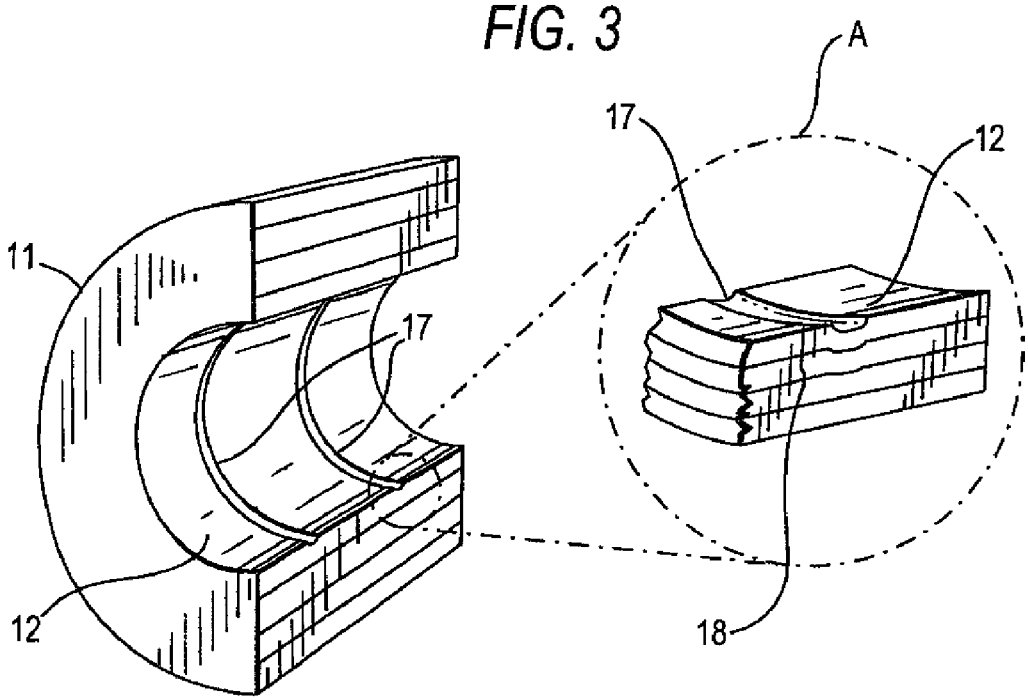
FIG. 3 shows a perspective view through the coil along with the detail "A" of an enlarged inner winding.

In accordance with FIG. 1, thin metal strip 1, especially thin steel strip, on a roller table 2 is coiled on a coiler mandrel 3*a* in a coiling station 3, in which the metal strip 1 is shaped and coiled by deflecting rolls 7 via a pair of drive rolls 4 and guides 5 and 6. In this regard, the deflecting rolls 7 and pressing rolls 8 can be adjusted by a control system with adjusting cylinders 9, which have position sensors 10.

This coiling operation produces a coil 11, as shown in FIG. 2. In the coiling station 3, which, for example, follows a hot-rolled wide strip rolling train, the coil 11 is formed on the coiler mandrel 3*a* in such a way that the (hot) metal strip 1 entering the station at rolling speed is wound around the coiler mandrel 3*a* via the pressing rolls 8 and the deflecting rolls 7, and the metal strip 1 is guided around hydraulically by means of the adjusting cylinder 9 and the position sensor 10, so that a first inner winding 12 with a strip leading end 13 is formed. The diameter of the coiler mandrel 3*a* can usually be adjusted by four movable segments 3*b* mounted around the circumference of the coiler mandrel 3*a*.

The coiler mandrel has a maximum and a minimum diameter, which is preset with mechanical stops. The coiling phase starts with an intermediate diameter, i.e., from this position of the segments 3*b*, it is possible, for one thing, to expand for the purpose of a rapid buildup of the frictional connection between the coiler mandrel 3*b* and the metal strip 1, and, for another, to contract the coiler mandrel 3*a* to allow the removal of the coil 11 from the coiler mandrel 3*a*.

In the initial coiling phase, the pressing rolls 8 and the coiler mandrel 3*a* rotate at a higher speed (so-called forward slip) than the strip 1 that is running in. The first inner winding 12 is laid around the pre-expanded coiler mandrel 3*a* and begins to tighten on the coiler mandrel 3*a*. The first inner winding 12 shows a tendency for its strip leading edge 13 to fall in below the inside diameter 14 of the eye 15 of the coil.

This collapse of the leading edge of the strip must be eliminated. In accordance with a first method, the following procedure is followed: The re-expansion phase starts, and the segments 3*b* are pressed into the first inner winding 12 with a force that depends on the metal strip 1 and the material from which it is made.

Figure 4:
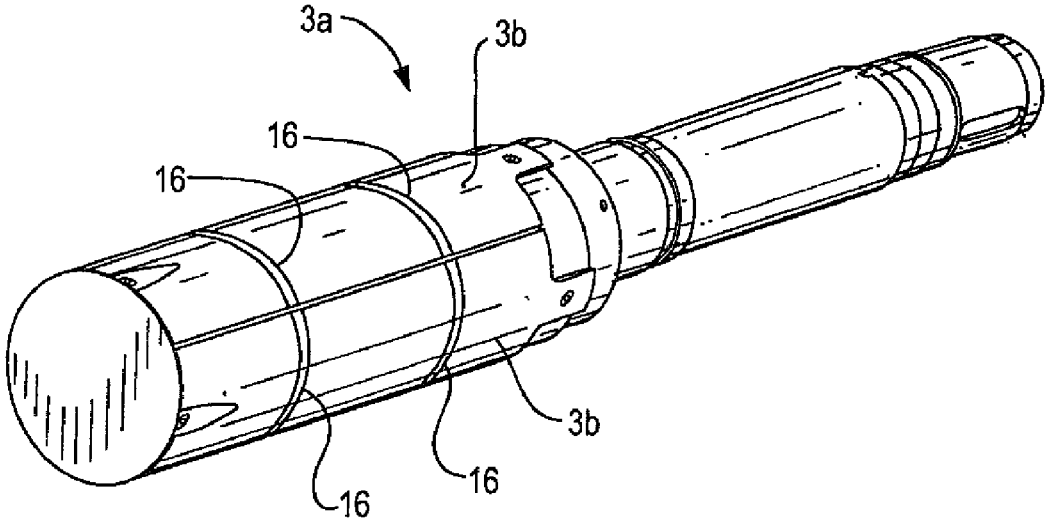
FIG. 4 shows a perspective view of a coiler mandrel.

For this purpose, profile ridges 16, which form segmentally peripheral elevations, are mounted on the segments 3*b* of the coiler mandrel 3*a* (FIGS. 3 and 4). With the forward slip or the re-expansion operation, the profile ridges 16 press profile grooves 17 (FIG. 3) into the metal strip 1. In this regard, a profile groove 17 can be pressed into the metal strip as far as the second inner winding 18, as shown in the enlarged detail A of FIG. 3. As a result, the inner windings 12 and 18 together behave more stiffly and prevent the tendency to collapse that is shown in FIG. 2.

The segmental profile ridges 17 can be designed to be interchangeable and may vary in width and height, i.e., they can be adapted to the given metal strip 1. The adaptation depends not only on the strip gage, but also on the material properties of the metal strip 1.

In accordance with a second method (FIG. 5); the inner windings 12, 18 are mechanically supported along the circumference during or immediately after the removal of the coil 11 from the coiler mandrel 3*a* in the eye 15 of the coil. The inner windings 12 and 18 are supported by radial expansion of support elements 19 away from the central axis.

The supporting of the inner windings 12 and 18 may overlap the removal of the coil 11 from the coiler mandrel 3*a*. The support elements 19 may be kept in the supporting position shown in the drawing during the coil conveyance and the cooling phase of the (hot) metal strip 1 up to the uncoiling of the coil 11.

The support elements 19 are part of an expansion adapter 20 inserted in the open eye 15 of the coil. The expansion adapter 20 is mounted on a holder (not shown) with a guide 21. The expansion adapter 20 is provided with connections 22 for media, power, and control mechanisms. The expansion adapter 20 can be rotated, as indicated by the arrows 23, and does not need to be removed until it reaches a subsequent station for treatment of the coil 11. The support elements 19 can be provided in one or more radial planes of the expansion adapter 20.

Figure 5:
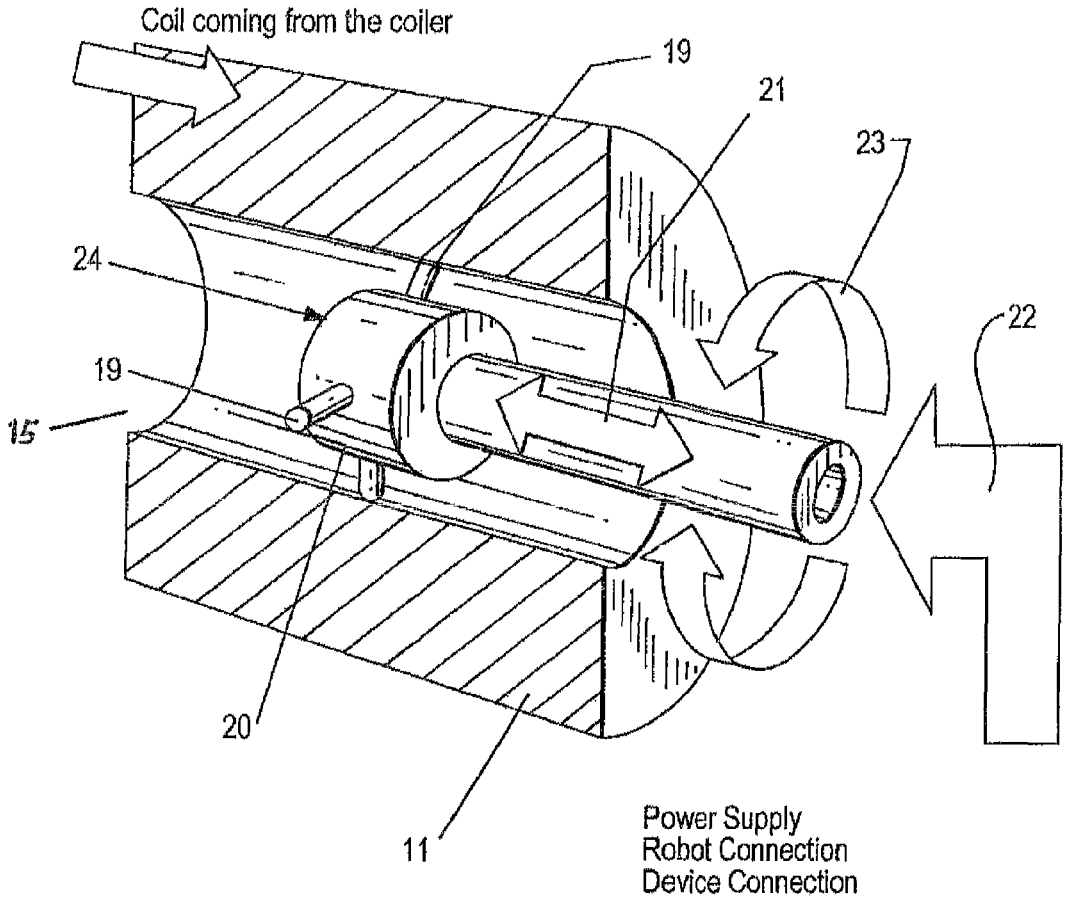
FIG. 5 shows a perspective cutaway view of a coil with an expansion adapter inserted.

In the operating position 24 shown in FIG. 5, the expansion adapter 20 can be locked in place in the eye 15 of the coil. The expansion adapter 20 is mass-produced and is assigned to each coil 11. The rotationally driven coiler mandrel 3*a* may also serve as the holder for the expansion adapter 20.

Figure 6:
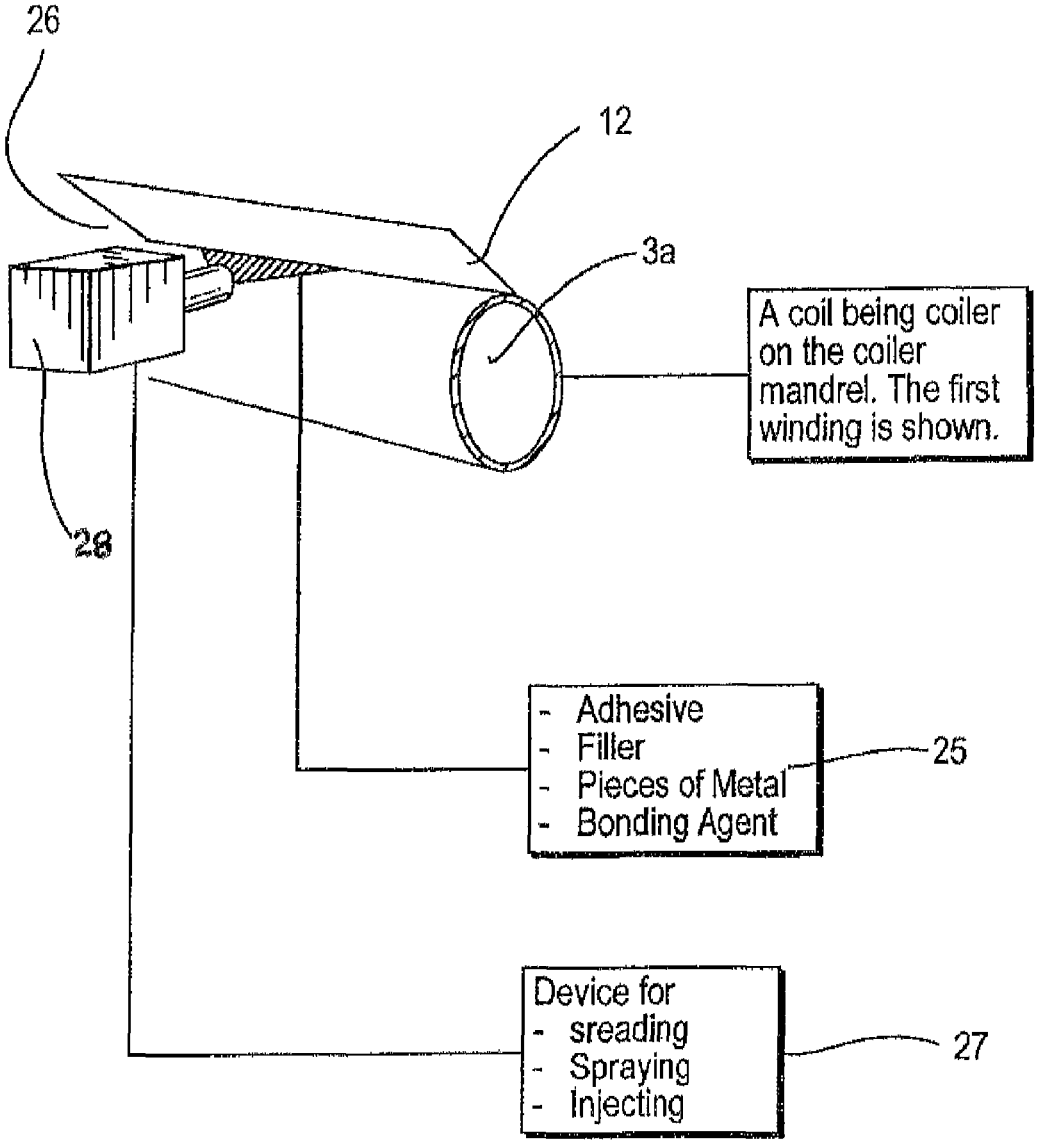
FIG. 6 shows the first inner winding of a coil that is being coiled on a coiler mandrel.

In a third method (FIG. 6), at least the first inner winding 12 and the second inner winding 18 are joined over a large area by introducing adhesives, fillers, metal bodies, and/or bonding agents 25 or the like into an angular space 26 between the inner windings 12 and 18. The adhesive is preferably sprayed into the angular space 26 between the first and second inner windings 12, 18. Similarly, a wire-like body can be introduced into the angular space 26 between the first inner winding 12 and second inner winding 18 as a filler to produce positive interlocking. Similarly, individual metal bodies can be introduced into the angular space 26 to produce the positive interlocking. It is also possible to introduce a bonding agent into the angular space 26 between the inner windings 12 and 18. The steps of the method described above can be carried out by means of a spreading, spraying, or injecting device 27 connected to a reservoir 28.

Figure 7:
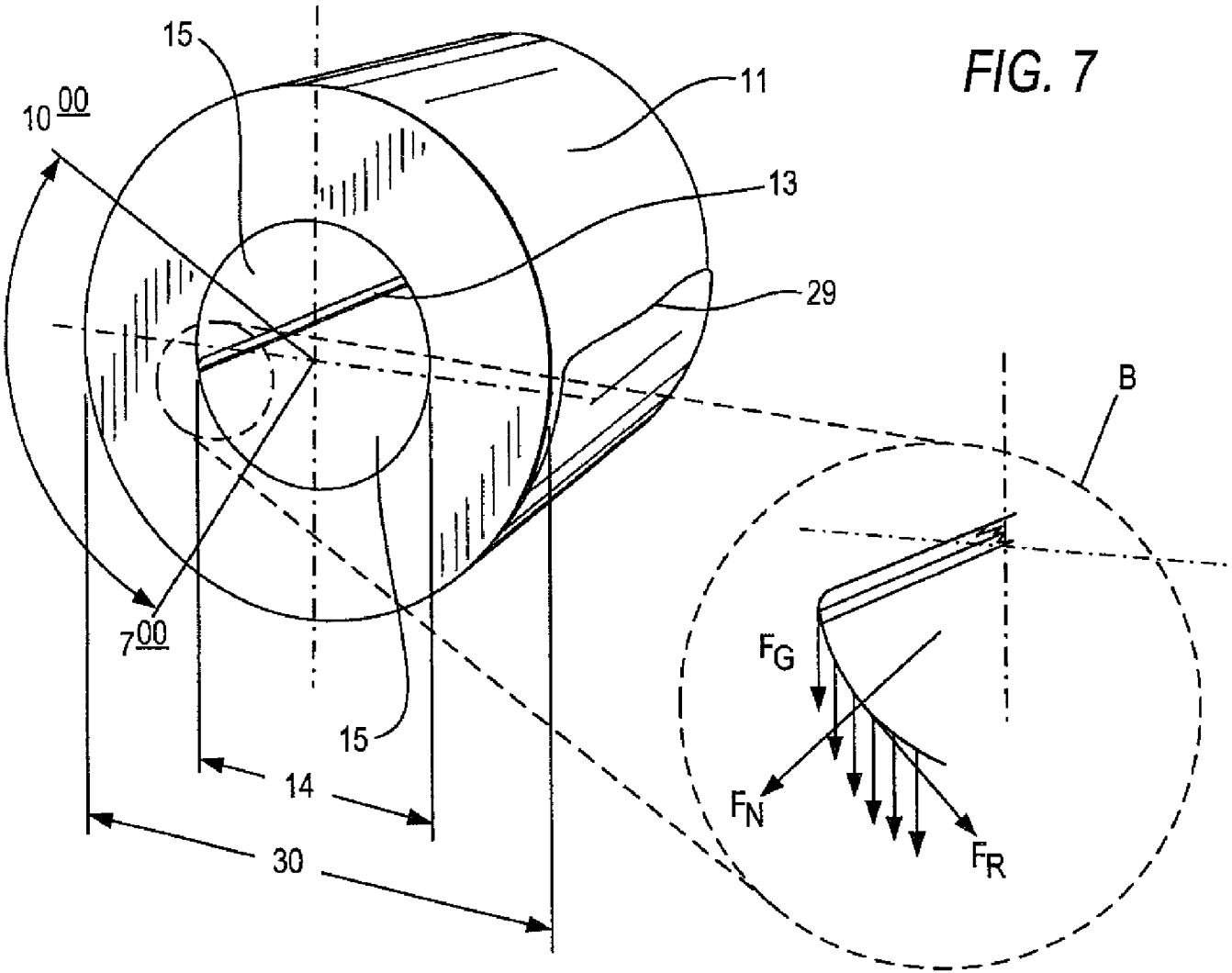
FIG. 7 shows a perspective view of a coil, whose strip trailing end and strip leading end are positioned by control measures.

A fourth method (FIG. 7) provides that, if the coil 11 is being wound in the clockwise direction, the leading end 13 of the strip is positioned in the eye 15 of the coil in an angular sector within the 7-10 o'clock range, and if the coil 11 is being wound in the counterclockwise direction, the leading end 13 of the strip is positioned in the eye 15 of the coil in an angular sector within the 2-5 o'clock range, and then the coil 11 is taken off the coiler mandrel 3*a*, the end of the strip to be positioned in an angular region below 270°.

The position of the given leading end of the strip is determined from the coil outside diameter 30, a speed sensor and correction values via the drive rolls 8 or the mean value of the drive roll peripheral speeds, via a speed signal from a speed measuring device, or via the surface speeds of the coiler mandrel 3*a* and the inner surface of the coil.

The weight $F_G$ (in the enlarged detail drawing B) of the leading end 13 of the strip forces (by normal force $F_N$) the leading end 13 of the strip to be pressed against the next inner winding, thereby preventing collapse of the winding, and, in addition, produces the frictional force $F_R$, which prevents the first inner winding 12 from separating from the second inner winding 18 or sliding on the second inner winding 18.

Figure 8:
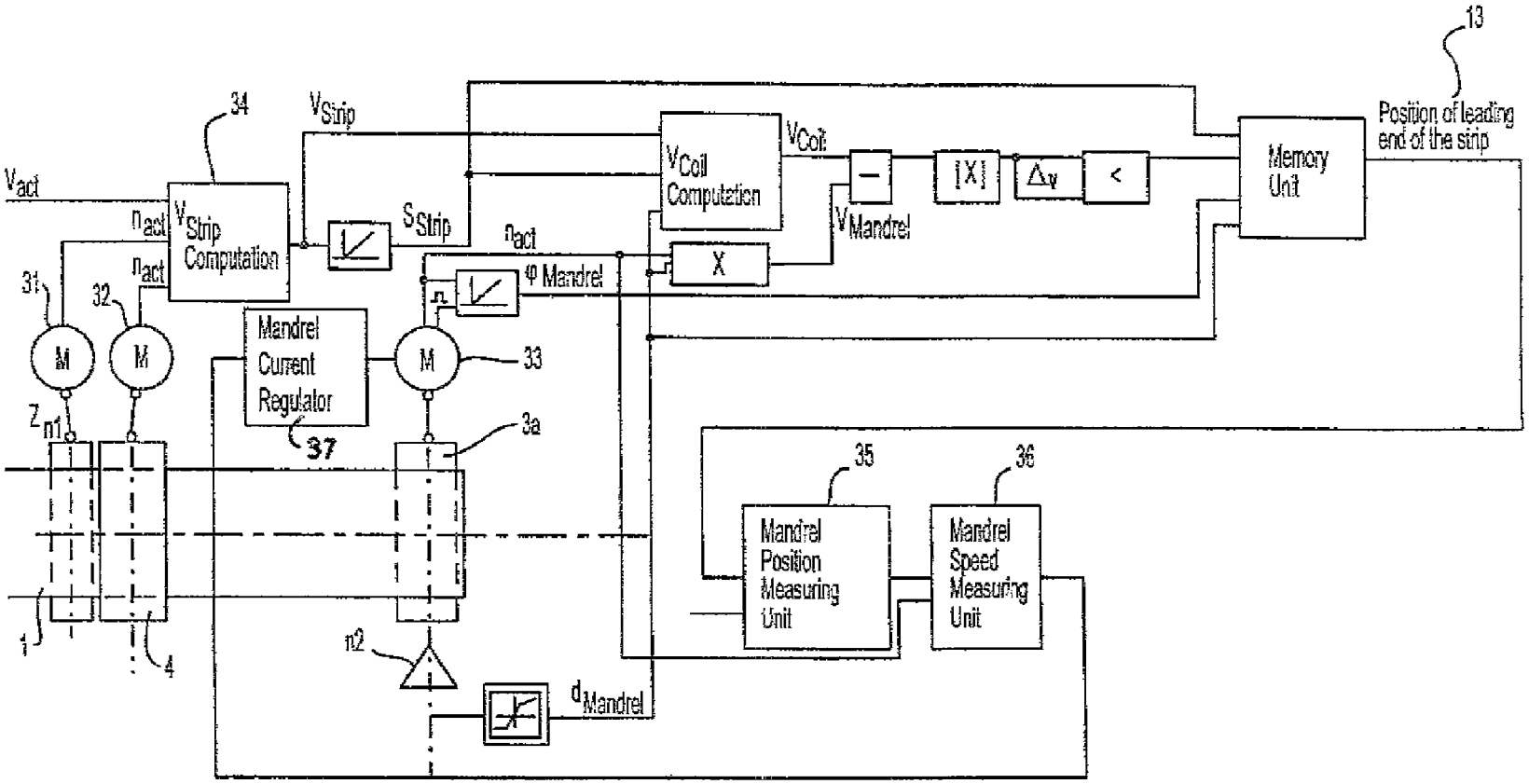
FIG. 8 shows a signal-flow diagram for the positioning of the leading end of the strip.

FIG. 8 shows a suitable signal-flow diagram for the positioning of the leading end 13 of the strip. The metal strip 1 is driven by the lower drive roll motor 31 and the upper drive roll motor 32, and a coiler mandrel motor 33 drives the coiler mandrel 3*a*. The position of the leading end 13 of the strip is determined by storage and integration of a speed signal from a speed measuring device 34 between a piece of rolling equipment and the coiling station 3 in speed n1. The surface speed of the inner surface of the coil 11 is determined from the speed signal used for the integration and from an instantaneous outer diameter and instantaneous inner diameter of the coil 11 being formed. To this end, the degree of mandrel expansion is determined from the speeds of the coil 11 and of the coiler mandrel 3*a* ($V_{mandrel}$) and as a function of the coiler mandrel diameter $d_{mandrel}$. The degree of mandrel expansion n2 is measured from the leading end 13 of the strip, a coiler mandrel position measuring unit 35, and a coiler mandrel speed measuring unit 36. From the coiler mandrel position measuring unit 35 and the coiler mandrel speed measuring unit 36, the coiler mandrel motor 33 is calculated via a coiler mandrel current regulator 37.

LIST OF REFERENCE NUMBERS

1 metal strip
2 roller table
3 coiling station
3*a* coiler mandrel
3*b* segment
4 pair of drive rolls
5 guide
6 guide
7 deflecting roll
8 pressing roll
9 adjusting cylinder
10 position sensor
11 coil
12 first inner winding
13 leading end of the strip
14 inside diameter
15 eye of the coil
16 profile ridges
17 profile groove
18 second inner winding
19 support elements
20 expansion adapter
21 guide
22 connections
23 arrows for rotation
24 operating position
25 adhesive, filler, etc.
26 angular space
27 spreading, spraying, injecting device
28 reservoir
29 trailing end of the strip
30 outside diameter of the coil
31 lower drive roll motor
32 upper drive roll motor
33 coiler mandrel motor
34 speed measuring device
35 coiler mandrel position measuring unit
36 coiler mandrel speed measuring unit
37 coiler mandrel current regulator
n1 speed
n2 degree of mandrel expansion

The invention claimed is:

1. Method for coiling thin metal strip, especially hot-rolled or cold-rolled thin steel strip (1), on a coiler mandrel (3*a*), which is adjusted in diameter, to form a coil, the method comprising initially coiling inner windings (12, 18) of the coil on the adjusted coiler mandrel diameter, and, after winding of the coil (11) is complete, pulling the coiler mandrel (3*a*) out of the coil, or taking the coil (11) off the coiler mandrel, wherein the inner windings (11, 12) of the coil (11) are mechanically directly supported along an inner circumference during or immediately after the removal of the coil (11) from the coiler mandrel (3*a*) in an eye (15) of the coil, the support of the inner windings of the coil being by linear radial expansion of support elements perpendicular to a central axis of the coil, the support elements being arranged completely within the eye.

2. Method in accordance with claim 1, wherein the supporting of the inner windings (11, 12) overlaps the removal of the coil (11) from the coiler mandrel (3*a*).

3. Method in accordance with claim 1, wherein the support elements (19) are kept in their supporting position during a coil conveyance and cooling phase, and up to an uncoiling of the coil (11).

* * * * *